US010143873B2

(12) United States Patent
Pahila et al.

(10) Patent No.: US 10,143,873 B2
(45) Date of Patent: Dec. 4, 2018

(54) LOW-LEAD RESIDENTIAL FIRE PROTECTION SPRINKLERS

(75) Inventors: Oliver S. Pahila, Liberty, SC (US); John Tow, Liberty, SC (US)

(73) Assignee: The Reliable Automatic Sprinkler Co., Inc., Liberty, SC (US)

( * ) Notice: Subject to any disclaimer, the term of this patent is extended or adjusted under 35 U.S.C. 154(b) by 158 days.

(21) Appl. No.: 13/635,314

(22) PCT Filed: Mar. 15, 2011

(86) PCT No.: PCT/US2011/028550

§ 371 (c)(1),
(2), (4) Date: Nov. 30, 2012

(87) PCT Pub. No.: WO2011/116012

PCT Pub. Date: Sep. 22, 2011

(65) Prior Publication Data

US 2013/0319697 A1 Dec. 5, 2013

Related U.S. Application Data

(60) Provisional application No. 61/313,987, filed on Mar. 15, 2010.

(51) Int. Cl.
*A62C 35/68* (2006.01)
*A62C 37/08* (2006.01)

(52) U.S. Cl.
CPC ..... *A62C 35/68* (2013.01); *A62C 37/08* (2013.01)

(58) Field of Classification Search
CPC ..... A62C 35/00; A62C 35/58; A62C 35/60; A62C 35/62; A62C 35/64; A62C 35/68;
(Continued)

(56) References Cited

U.S. PATENT DOCUMENTS 4,580,729 A * 4/1986 Pounder ..... A62C 37/12 169/37
H0000121 H * 9/1986 Pieczykolan ..... 169/137
(Continued)

FOREIGN PATENT DOCUMENTS

EP 1 916 313 A1 4/2008
WO 03/105962 A1 12/2003

OTHER PUBLICATIONS

ECO Brass Overview, Apr. 17, 2003, www.ecobrass.com (availabel Apr. 17, 2003 per the wayback machine internet archive).*
(Continued)

*Primary Examiner* — Justin Jonaitis
(74) *Attorney, Agent, or Firm* — Fitzpatrick, Cella, Harper & Scinto

(57) ABSTRACT

A fire protection sprinkler includes a body having an inlet end, including a threaded base configured to connect to a fluid supply conduit, an outlet end, and a water passage defined therein. The water passage includes an inlet orifice, provided at the inlet end of the body, an output orifice, provided at the outlet end of the body, and an interior surface formed of a material having a weighted average lead content of 0.25% or less. A seal cap, that moves between a closed position, in which the seal cap seals the output orifice of the water passage, and thereby prevents flow of a fluid from the fluid supply conduit through the output orifice, and an open position, in which the seal cap does not seal the output orifice of the water passage, has water-exposed surfaces formed of a material having a weighted average lead content of 0.25% or less.

10 Claims, 7 Drawing Sheets

(58) Field of Classification Search
CPC ..... A62C 35/605; A62C 37/00; A62C 35/645; A62C 31/02; A62C 37/08; A62C 37/09; A62C 37/10; A62C 37/11; A62C 37/12; A62C 37/14; A62C 37/16; A62C 99/0072; Y10S 239/15; B05B 1/262; B05B 1/265; B05B 1/267
USPC ..... 169/5, 16, 17, 37
See application file for complete search history.

(56) References Cited

U.S. PATENT DOCUMENTS

| | | | | |
|---|---|---|---|---|
| 4,896,728 | A * | 1/1990 | Wolff | A62C 37/10 169/26 |
| 4,964,471 | A | 10/1990 | Michalik et al. | |
| 5,862,994 | A * | 1/1999 | Pounder et al. | 239/498 |
| 2002/0011527 | A1 | 1/2002 | Onuki | |
| 2006/0102362 | A1* | 5/2006 | Polan | A62C 37/09 169/37 |

OTHER PUBLICATIONS

Mueller Brass, Alloy 2745 Machining Reference Guide, May 30, 2008.*

Freedom® Residential Horizontal Sidewall Lead Free Sprinkler VK4860 (K4.0), Sprinkler 156a, The Viking Corporation, Jan. 13, 2012, http://www.vikinggroupinc.com/databook/Old/Sprinkler1/011212jan2012.pdf, last retrieved Aug. 1, 2013.

PCT International Search Report dated Jun. 29, 2011 in PCT /US2011/028550.

International Preliminary Report on Patentability and Written Opinion of the International Searching Authority dated Sep. 18, 2012, in PCT/US2011/028550.

European Search Report dated Mar. 30, 2017, issued in counterpart European Patent Appln. No. 17150136.4.

Canadian Office Action dated Oct. 19, 2017, issued in counterpart Canadian Patent Appln. No. 2,793,366.

EPO Communication Under Rule 71(3) of the EPC dated Jul. 29, 2016, issued in counterpart European Patent Appln. No. 11711193.0.

Alloy 2745, Mueller Brass, 2001, http://www.muellerindustriesipd.com/pdfs/2745_machining_ref_guide_e_version.pdf.

Green Dot™ Rod & the Eco Brass® Ingot, ECO BRASS, 2007, http://www.cmxmetals.com/wp-content/uploads/eco-brass-general-properties.pdf.

Canadian Office Action dated Jun. 28, 2018, in corresponding Canadian Patent Application No. 2,793,366.

* cited by examiner

LOW-LEAD RESIDENTIAL FIRE PROTECTION SPRINKLERS

RELATED APPLICATION

This application is a national stage application under 35 U.S.C. § 371 of International Patent Application No. PCT/US11/28550, filed Mar. 15, 2011, which incorporates by reference the entire contents of U.S. Provisional Patent Application No. 61/313,987, filed Mar. 15, 2010, and claims benefit of the filing date of that provisional application under 35 U.S.C. § 119(e).

BACKGROUND OF THE INVENTION

This application relates to a fire protection method and system, particularly, for the protection of residential occupancies, although the fire protection method and system are applicable to other occupancies as well.

In the long history of fire protection technology in the United States, going back to the 1800s, it has been conventional to design and to construct fire prevention sprinkler systems that use, as a fire-extinguishing fluid, water supplied from a pipe system that is separate from the pipe system that supplies drinking water to an occupancy.

U.S. Pat. No. 4,964,471 shows one example of such a sprinkler system. The system is designed for use with ducts carrying corrosive gases, and has a multiplicity of sprinkler assemblies, each having an easily replaceable adapter with a sprinkler head having a fusible alloy fill. The sprinkler head is screwed into one end of the adapter that has an integral flange at an opposite end. The adapter is inserted into a flanged nozzle that is part of the duct. The adapter flange is bolted to the nozzle flange that has a central opening adapted for connection to a source of an extinguishing fluid.

An element of such a sprinkler is shown in U.S. Patent Application Publication No. 2002/0011527. This publication discloses a sprinkler head that includes a body having one end adapted for connection to a supply of pressurized fluid, another end that is closed by a valve element, and a thermally responsive assembly for normally holding the valve element in a closed position and for opening the valve element at a preset temperature to cause the pressurized fluid to flow out of the other end of the body. The thermally responsive assembly includes a holder and a fusible alloy that is contained within the holder and held in place by a plunger.

A further possible element of this type of a sprinkler is shown in International Publication No. WO 03/105962. This publication discloses a sealing cap for a nozzle in a sprinkler system, in which the nozzle is formed as a spray nozzle of the turbo type that is connected in series in the sprinkler system, and in which the sealing cap is fitted over the nozzle and is arranged to protect the nozzle lying inside.

As a result of requirements imposed by governmental fire codes and by insurers, commercial and other public buildings, including large, multi-residential occupancies, are normally provided with a fire protection sprinkler system when first built. With increased attention to fire safety in the single-family home, however, a need exists for a way to install such a system in single-family residences more easily and at a lower cost. If a potable-water supply of a building can also be used to supply water to the fire protection sprinkler system, it is possible to dispense with a large amount of additional piping that would otherwise be required. As a result, the expense involved in installing such a system can potentially be lowered, especially in a building having relatively little space for plumbing.

Moreover, environmental considerations may also lead to a preference for a fire protection sprinkler system that can receive water from the same interior piping supply as used for domestic-use water in a building.

With conventional fire protection sprinkler systems, however, this is not possible because the materials conventionally found suitable for use in constructing a fire protection sprinkler contain levels of lead and various other substances that preclude the use of those materials on elements exposed to potable (i.e., drinking) water. As one requirement, for example, the materials that form surfaces of fire protection sprinklers that are exposed to potable water must have a lead content of not more than 0.25% by weight. As another example, such materials must have a single product allowable concentration ("SPAC") for lead of less than or equal to 0.5 μg per liter (0.5 part per billion), a total allowable concentration ("TAC") for lead of less than or equal to 5 μg per liter (0.5 part per billion), and lead test statistic Q of less than 5 μg when normalized for a 1 liter first draw sample, when the test statistic Q is defined in accordance with the National Sanitation Foundation and American National Standards Institute Standard for Drinking Water System Components 61-2010a Annex F (NSF/ANSI 61-2010a Annex F).

SUMMARY

To address this problem, therefore, our invention provides a fire protection sprinkler that can safely be used in a system that contains potable (i.e., drinking) water.

Accordingly, the present application provides a fire protection sprinkler in accordance with the claims that follow.

The present disclosure, more particularly, provides a fire protection sprinkler that can be used with a dual-use or multipurpose supply (that is, an interior-piping system and a water supply for the fire protection sprinkler can be the same interior-piping system and water supply that are used for domestic outlets, such as bathroom and kitchen taps, such that the water is acceptable for drinking). In one embodiment, the fire protection sprinkler comprises a sprinkler body having an inlet orifice, an outlet orifice, and an interior surface that defines a water passage between the inlet orifice and the outlet orifice. A seal cap is configured to seal a flow of a fluid from the outlet orifice, and includes at least one water-exposed surface. A thermally-responsive element is configured to releasably retain the seal cap in the outlet orifice until actuation of the fire protection sprinkler in response to a fire condition. The fire protection sprinkler also comprises a deflector to direct the water in a desired pattern as the water exits the outlet orifice. The interior surface that defines the water passage is made of a material that does not release potentially harmful substances, such as lead, into the water. The entire sprinkler body may be made of that same material, as well, and the seal cap may be made of the same material. Alternatively, the seal cap may be made of another material that does not release potentially harmful substances into the water. Several fire protection sprinklers according to embodiments of our invention are shown in the attached figures and described herein.

It should be noted that our invention is fully applicable to the construction of fire protection sprinklers without any limitation as to the nominal K-factor of the fire protection sprinkler, which is defined by $K=Q/\sqrt{p}$, where Q is the flow rate in liters per minute and p is the residual pressure at the inlet of the fire protection sprinkler in kilopascals as to whether the fire protection sprinkler is a pendent, an upright, or a sidewall type, or as to whether the fire protection sprinkler is designed for use as a control mode sprinkler, a suppression mode sprinkler, or any other type. And, while a residential application is particularly contemplated, our invention is believed to be fully applicable to fire protection sprinklers for use in other types of occupancies, as well.

It should also be noted that while it is most particularly contemplated that the invention will be practiced utilizing a metallic material, particularly an alloy, as the material of the interior surface of the body, it is also within the scope of the invention to utilize other materials that display the requisite chemical stability in terms of not releasing significant amounts of heavy metals, or other materials that would be unacceptable in drinking water, into water that contacts the interior surface of the body.

For example, it is also within the scope of the invention to form the body of the fire protection sprinkler out of a plastic material or out of a conventional metal with the entire interior (water-exposed) surface of the body being coated with a plastic to prevent the release of any lead, or other harmful material present in the metal itself, into the water.

Similarly, it is also within the scope of the invention to form the body of the fire protection sprinkler out of a vitreous material or to make it out of a conventional metal with the entire interior (water-exposed) surface of the body being coated with such a vitreous material to prevent the release of any lead, or other harmful material present in the metal itself, into the water.

Additional aspects, objects, features and advantages of the present invention will be more fully appreciated from the following detailed description of certain preferred embodiments, taken in conjunction with the accompanying drawings.

DETAILED DESCRIPTION OF THE PREFERRED EMBODIMENTS

Figure 1A:
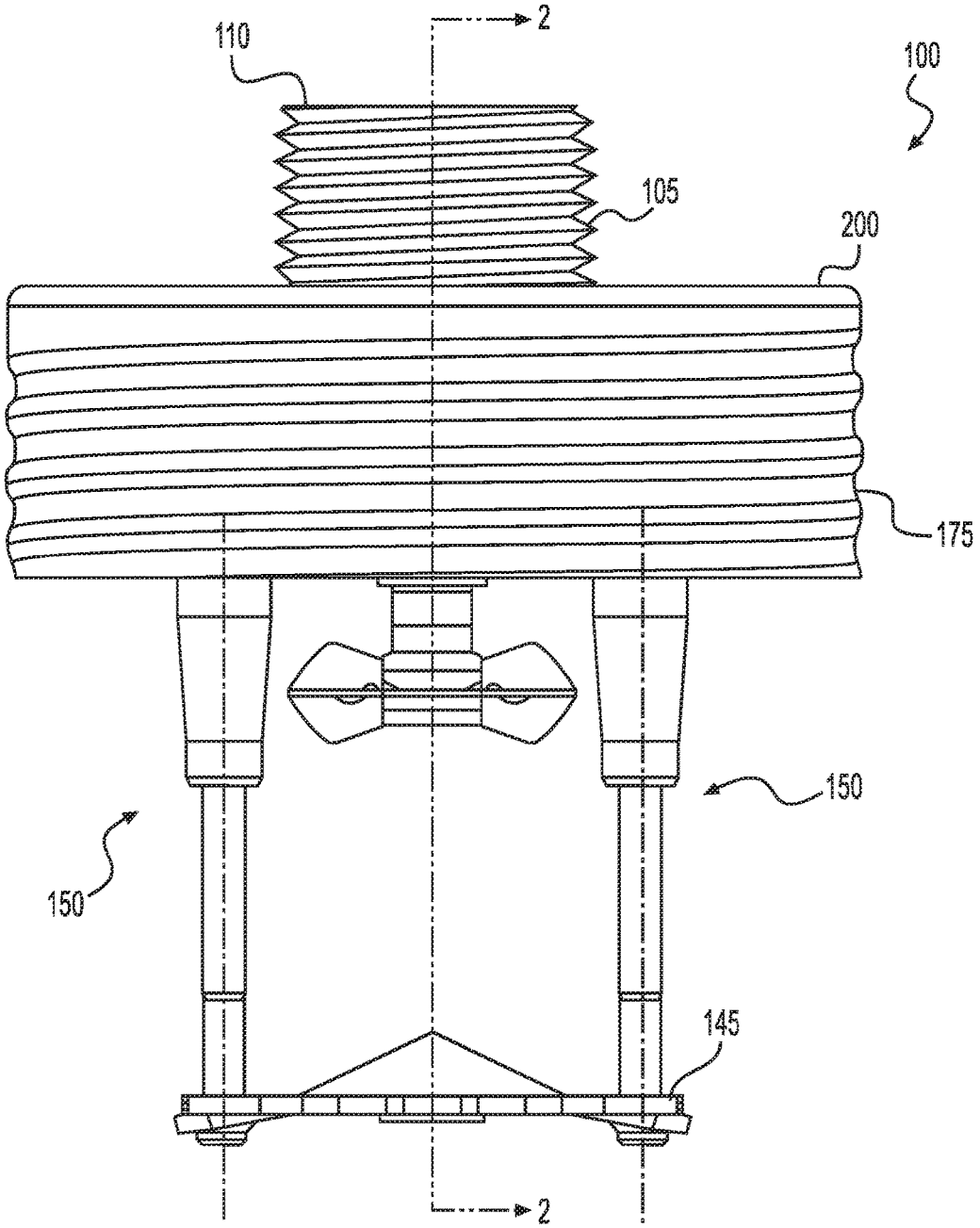
FIG. 1A is a side view of a fire protection sprinkler according to a first embodiment of the invention.

Several preferred embodiments of our invention will be described below, with reference to the drawings. Reference numerals used throughout the drawings represent the same elements.

FIGS. 1A-3B illustrate a first embodiment of a fire protection sprinkler 100 suitable for use in a fire protection sprinkler system for a residential occupancy. As shown in these figures, the fire protection sprinkler 100 is a drop-down pendent type and includes a deflector 145, shown in a dropped or extended position, as will be described. The structure of the fire protection sprinkler 100, as shown in these figures, can be applied equally well, however, to pendent or upright, concealed or non-concealed, and horizontal configurations of sprinkler as well.

Figure 2:
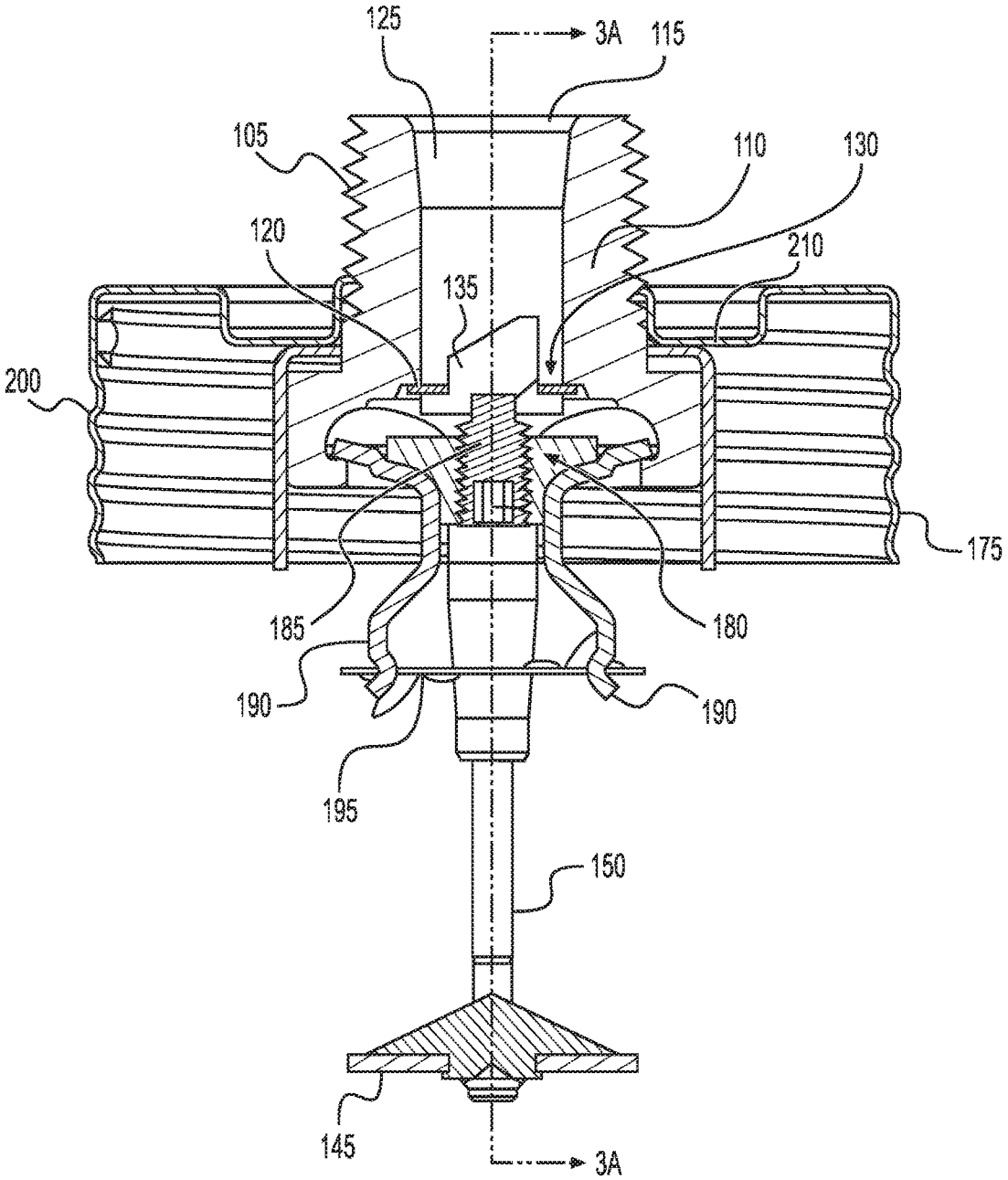
FIG. 2 is a view, partly in section, along the section line of the fire protection sprinkler shown in FIG. 1A.

As shown in FIGS. 1A and 2, a pendent fire protection sprinkler 100 in accordance with the present invention has a body 110 with a threaded portion 105 for connection to a conduit (not shown) that supplies pressurized fire-extinguishing fluid, such as water, to the fire protection sprinkler 100. As shown in FIG. 2, the body 110 has an axial bore 125 with an outlet orifice 130 from which the fire-extinguishing fluid is output upon release of a seal cap 135. The output orifice 130 may have a diameter of, for example, 9.53 mm (⅜ inch). The fire protection sprinkler 100 may have a nominal K-factor of, for example, of 193.5 $L/s\cdot(kPa)^{1/2}$ (4.3 $gpm/(psi)^{1/2}$). As noted, however, the scope of the invention is not limited to the above-noted diameter or K-factor. The body 110 also has a hexagonal flange (not shown) around the outlet end.

Figure 1B:
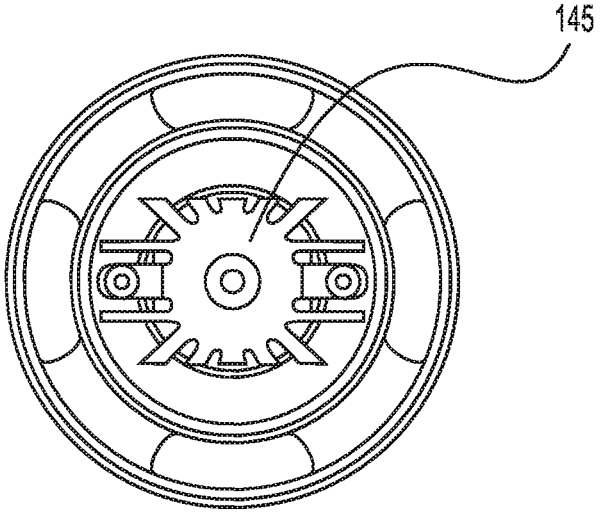
FIG. 1B is a bottom view of the fire protection sprinkler shown in FIG. 1A.

The deflector 145 is coupled to two deflector support members 150 on opposite sides of the body 110. FIG. 1B shows a bottom view of the deflector 145, and FIG. 3B shows a detail view of the manner in which the deflector 145 is supported by the body 110, described below. Each of the support members 150 includes a housing member 155 that extends downward from the body 110, and a rod 165 that is movable with respect to the housing member 155.

For example, the housing member 155 may be a tubular structure positioned within and extending downward from the body 110, and the rod 165 may be a solid, generally cylindrical member contained within the housing member 155. Numerous other configurations for the housing members 155 and rods 165 are also possible. For example, the rods 165 may be tubular members, rather than solid members, and the rods 165 may have another cross-sectional shape, e.g., square, hexagonal, cylindrical, telescopic, etc. In addition, the housing members 155 may be separate components from the body 110, as shown, or may be formed unitarily with other portions of the body 110, for example.

Figure 3A:
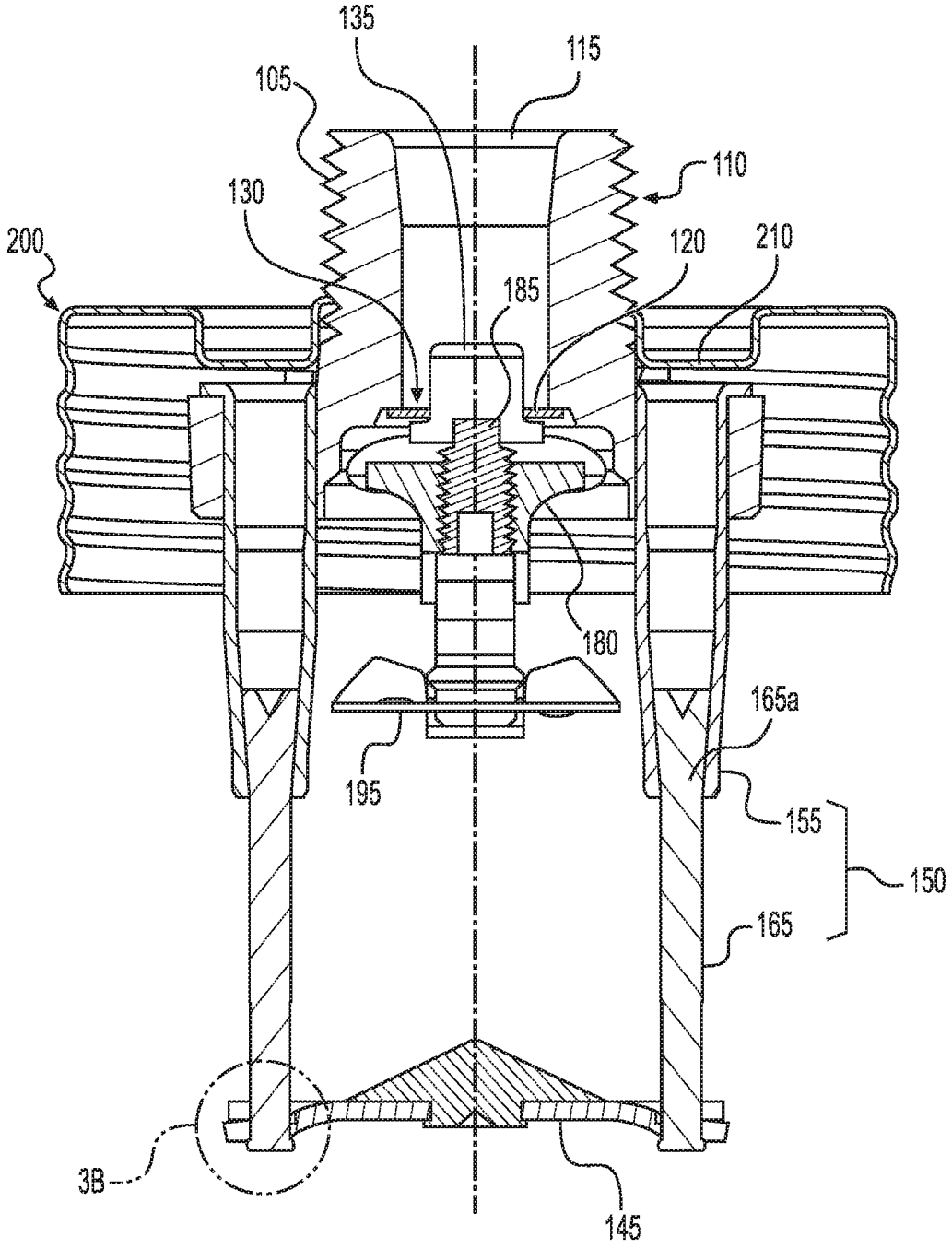
FIG. 3A is a view partly in section, along the section line of the fire protection sprinkler shown in FIG. 2.
Figure 3B:
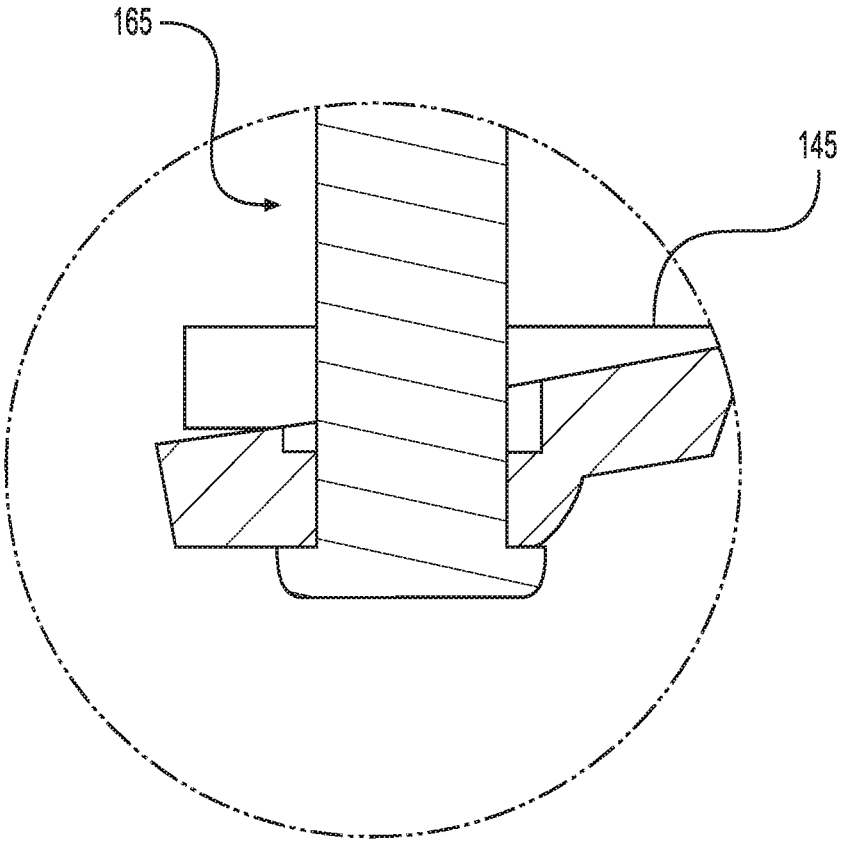
FIG. 3B is a detail view of a portion of the fire protection sprinkler shown FIG. 3A.

During operation, the rods 165 slide from an initial position, in which a large portion of a length of each rod 165 is within the corresponding housing member 155, to a deployed position, in which a substantial portion of the length of each rod 165 extends from the bottom of the corresponding housing member 155 (as shown in FIGS. 1A, 2, and 3A). Accordingly, in the deployed position, the deflector 145 moves downward along with the rods 165 (see FIG. 2).

The threaded portion 105 at the top of the body 110 has threads on an outer surface to allow the fire protection sprinkler 100 to be connected to a conduit (not shown) that provides pressurized water to an inlet orifice 115 of the body 110. Of course, the fire protection sprinkler 100 can be used with other fire-extinguishing fluids. Since, however, a purpose of our invention is to provide a fire protection sprinkler that can be used with a potable water supply, reference herein will be made only to water as the fire-extinguishing fluid used.

The body 110 has an outlet orifice 130 that is normally kept closed by a seal cap assembly that includes a seal cap 135 and a washer 120, secured with tape (not shown) of a fluoroplastic material, such as that sold under the trademark Teflon® (a registered trademark of the E.I. DuPont de Nemours Co.). A yoke 180 and a load screw 185 are positioned below the seal cap assembly, with the load screw 185 pressing the seal cap 135 upward into the outlet orifice 130. Two levers 190 are placed adjacent to the yoke 180 with one lever 190 on each side. Below the outlet orifice 130, an interior of the body 110 widens and forms a shoulder structure that provides a surface on which an upper end of each lever 190 rests. A lower end of each lever 190 resiliently engages a link mechanism 195 that cooperates with the yoke 180, the load screw 185, and the levers 190 to press the seal cap assembly into place in the outlet orifice 130, preventing water from leaving the outlet orifice 130 until the fire protection sprinkler 100 is actuated.

The fire protection sprinkler 100 also has a thermally-responsive element that holds the seal cap 135 in place over the outlet orifice 130. Different types of thermally-responsive elements are well known in the art although types other than a link mechanism will not be described in detail. The link mechanism 195 may comprise thin metal plates of, e.g., beryllium-nickel alloy, overlapping such that openings in each plate receive the lower ends of the levers 190. In such an arrangement, the metal plates may be attached to each other with solder that melts at a predetermined temperature. The metal plates of the link mechanism 195 separate at the predetermined temperature, due to the melting of the solder and the force applied by the levers 190. As a result, the levers 190 to swing outward, releasing the seal cap 135 and allowing the water to be output from the outlet orifice 130. Other types of thermally-responsive elements may be used, including, but not limited to, for example, a frangible bulb and lever assembly, or a sensor, strut, and lever assembly.

More detail on one possible structure and manner of operation of the link mechanism 195, as the thermally responsive element, and the levers 190 may be found in commonly-assigned U.S. Pat. No. 7,275,603.

The fire protection sprinkler 100 is mounted in a support cup 200 having a cylindrical, threaded outer wall 175 that surrounds a portion of the installed fire protection sprinkler 100 and allows for installation of the fire protection sprinkler 100 into a ceiling cavity. The support cup 200 also has a mounting platform 210 having a central hole into which the body 110 of the fire protection sprinkler 100 is inserted. The hole has a threaded rim portion or tabs configured to interlock with the threaded portion 105 of the body 110.

As shown in FIG. 3A, the rods 165 of the deflector support members 150 that slide between a position within the housing members 155 and an extended position, each have a frustoconical portion 165*a*, at a top of the rod 165, that forms a small angle relative to a longitudinal axis of the rod 165. The frustoconical portion 165*a* tapers from the top end to the bottom end.

Figure 4:
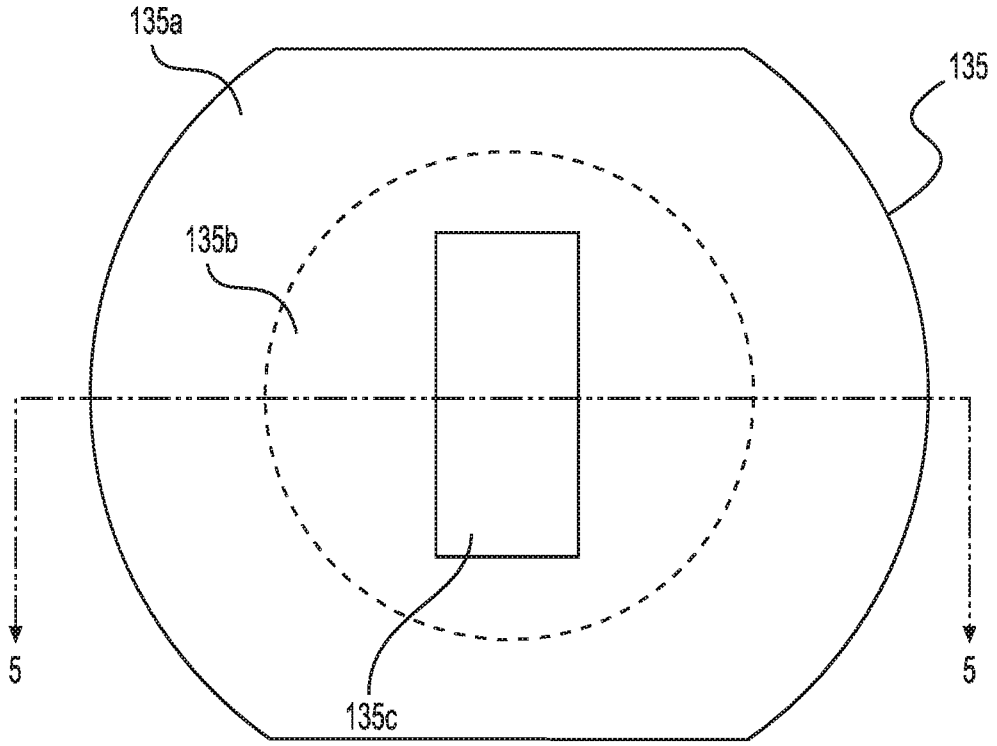
FIG. 4 is a view showing the top of one component of a fire protection sprinkler according to one embodiment.
Figure 5:
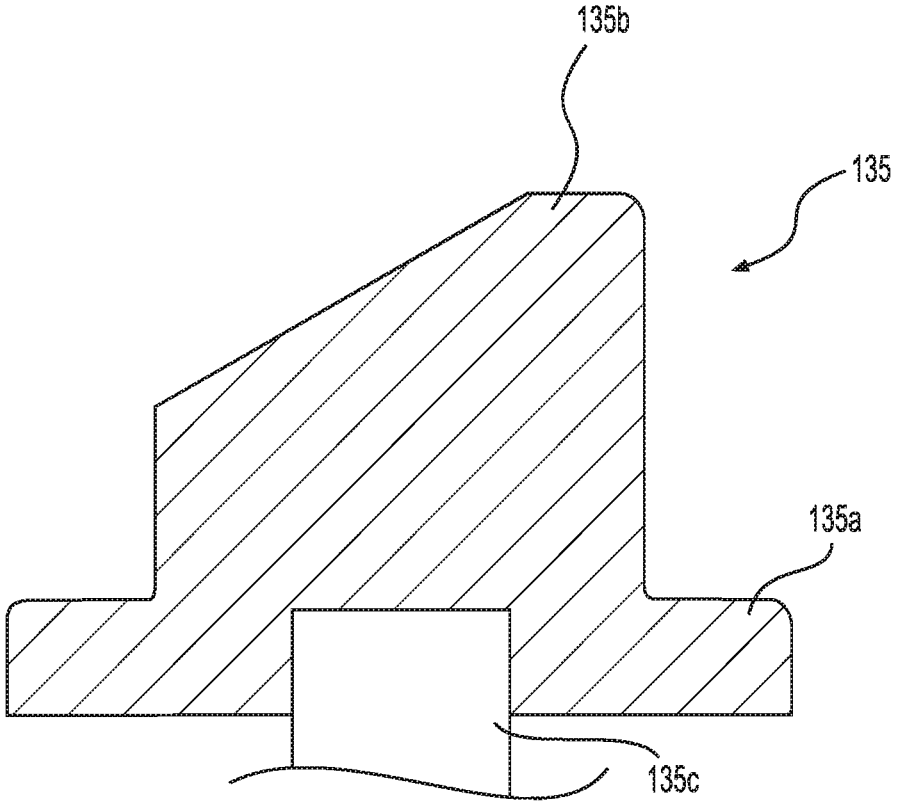
FIG. 5 is a sectional view of the one component of the fire protection sprinkler along the section line in FIG. 4.

FIGS. 4 and 5 show the seal cap 135 in more detail. As shown in FIG. 5, a broad portion 135*a* of the seal cap 135 has a recess 135*c* formed in a lower surface that is configured to engage with the load screw 185. A narrow portion 135*b* of the seal cap 135 that extends into the water passage of the body 110 is formed with a surface having an angle of 60°, as this has been found to ensure that the seal cap 135, as well as the other components of the fire protection sprinkler 100 that are below the seal cap 135, are cleanly moved out of the way of the water exiting the fire protection sprinkler 100 when the fire protection sprinkler 100 is actuated.

When the fire protection sprinkler 100 is deployed, as shown in FIGS. 1A, 2, and 3A, the rod 165 lodges in the housing member 155. By using the above-described configuration, the deflector 145 is more stable when deployed, allowing for a consistent sprinkler spray pattern.

When the fire protection sprinkler 100 is installed, water is in contact with a number of surfaces of the fire protection sprinkler 100, such as the interior surface of the axial bore 125 of the body 110, and the seal cap 135. As a result of the contact between water and these elements, substances contained in the materials of the fire protection sprinkler 100 may be released into the water. For a fire protection sprinkler having a K-factor of 126.13 L/s·(kPa)$^{1/2}$ (reflective of a K factor of 2.8 gpm/(psi)$^{1/2}$ in imperial units) for example, the surface area of the fire protection sprinkler that is in contact with the water is over 6.45 cm$^2$ (1 square inch), and for a fire protection sprinkler having a K-factor of 198.20 L/s·(kPa)$^{1/2}$ (reflective of a K factor of 4.4 gpm/(psi)$^{1/2}$ in imperial units), the surface area may exceed 7.8 cm$^2$ (1.16 square inches). For fire protection sprinklers having larger K-factors, of course, the surface area will be larger. The larger the surface area, the greater the likelihood that an unacceptable amount of lead or other harmful substance will be released into the water.

This concern is addressed by manufacturing the surfaces of the fire protection sprinkler 100 that contact the water using a material that will not release problematic amounts of lead or other harmful substances into the water. Examples of materials that have been successfully tested include alloy 2745 and ECO Brass®, when used for the sprinkler bodies and sealing caps. For convenience, these and similar materials will be referred to collectively as "low-lead releasing materials".

Use of the low-lead releasing materials, described above, in forming at least the body and the seal cap of a fire protection sprinkler results in the release of relatively smaller quantities of lead and other harmful or potentially harmful substances into the water that contacts the fire protection sprinkler. Examples of the harmful or potentially harmful materials include antimony, arsenic, beryllium, copper, mercury, thallium, and barium. In fact, a standard test for lead content in water that contacts a fire protection sprinkler having water-exposed surfaces formed of low-lead releasing materials having less than 0.25% weight average lead content showed that it is possible to reduce the release of such harmful or potentially harmful substances into the water to acceptable levels, as required by various standards that will or may come into force in the near future. Fire protection sprinklers made in accordance with our invention have been subjected to the rigorous testing required of products that will contact drinking water, and have been granted listing by the National Sanitation Foundation (NSF International). In particular, fire protection sprinklers manufactured by The Reliable Automatic Sprinkler Co., Inc., including model nos. RFC49, RFC43 and F1-RES 30, F1-RES44, F1-RES 49, and F1-RES 58 can successfully be made using such materials, and have met the requirements set forth in the National Sanitation Foundation and American National Standards Institute Standard for Drinking Water System Components 61, Annex G, relating to testing for unacceptable or problematic levels of materials other than lead, including those listed herein.

Preferably, the body 110 and the seal cap 135 of the fire protection sprinkler 100 are formed of one of alloy 2745 or ECO Brass®, as these portions can be manufactured using techniques similar to those used in manufacturing the same portions of conventional fire protection sprinklers, thus permitting the manufacture of a low-lead sprinkler without an unreasonably high cost. Other materials, however, can be used. As one example, the surfaces that will contact the water may be coated with a layer of a polymeric material, such as polytetrafluoroethylene (PTFE, also known as Teflon®) or fluorinated ethylene propylene (FEP, also known as Teflon® FEP), formed by deposition on the surfaces of the axial bore 125 of the body 110 and of the sealing cap 135 of the fire protection sprinkler 100. Alternatively, the body 110 and the sealing cap 135 of the fire protection sprinkler 100 may be made entirely of a polymeric material. In addition, the body 110 and the sealing cap 135 of the fire protection sprinkler 100 may be made of a vitreous material, or coated with a vitreous material. As another example, the body 110 and the sealing cap 135 of the fire protection sprinkler 100 may be made of metals or alloys that are otherwise desirable for use in view of their strength, reliability, low cost, or other properties, with a coating of one of the above alloys being applied to the surfaces that will contact the water.

While the present invention has been described with respect to what are, at present, considered to be the preferred embodiments, it is to be understood that the invention is not limited to the disclosed embodiments. To the contrary, the invention is intended to cover various modifications and equivalent arrangements included within the spirit and scope of the appended claims.

What is claimed is:

1. A fire protection sprinkler comprising:

(A) a body having (a) an inlet end, including a threaded base configured to connect to a fluid supply conduit that supplies a fluid, (b) an outlet end, and (c) a water passage defined therein, the water passage including (i) an inlet orifice, provided at the inlet end of the body, (ii) an output orifice, provided at the outlet end of the body, and (iii) an interior surface coated with a layer of a polymeric material having a weighted average lead content of 0.25% or less;

(B) a seal cap configured to move between (a) a sealed state, in which the seal cap seals the output orifice of the water passage, and thereby prevents flow of the fluid from the fluid supply conduit through the output orifice, and (b) an unsealed state, in which the seal cap does not seal the output orifice of the water passage, and the seal cap having water-exposed surfaces coated with a layer of the polymeric material having a weighted average lead content of 0.25% or less;

(C) a thermally-responsive element positioned to releasably retain the seal cap in the sealed state, the thermally-responsive element configured to operate in response to ambient temperature reaching a predetermined temperature, thereby releasing the seal cap from the sealed state;

(D) at least two support members, each having (a) an upper end connected to the outlet end of the body, and (b) a lower end; and (E) a deflector connected to the lower end of each of the at least two support members, and configured to deflect the fluid that flows through the output orifice upon release of the seal cap from the sealed state.

2. The fire protection sprinkler according to claim 1, wherein the fire protection sprinkler has a K-factor in a range from 2.8 gpm/(psi)$^{1/2}$ to 5.8 gpm/(psi)$^{1/2}$, inclusive.

3. The fire protection sprinkler according to claim 1, wherein the polymeric material is polytetrafluoroethylene.

4. The fire protection sprinkler according to claim 1, wherein the polymeric material is fluorinated ethylene propylene.

5. A fire protection sprinkler and support cup assembly configured to be mounted in a ceiling cavity of a residential occupancy, the assembly comprising:

(A) a fire protection sprinkler comprising:

(a) a body having (i) an inlet end, including a threaded base configured to connect to a fluid supply conduit that supplies a fluid, (ii) an outlet end, and (iii) a water passage defined therein, the water passage including (1) an inlet orifice, provided at the inlet end of the body, (2) an output orifice, provided at the outlet end of the body, and (3) an interior surface coated with a layer of a polymeric material having a weighted average lead content of 0.25% or less;

(b) a seal cap configured to move between (i) a sealed state, in which the seal cap seals the output orifice of the water passage, and thereby prevents flow of the fluid from the fluid supply conduit through the output orifice, and (ii) an unsealed state, in which the seal cap does not seal the output orifice of the water passage, and the seal cap having water-exposed surfaces coated with a layer of the polymeric material having a weighted average lead content of 0.25% or less;

(c) a thermally-responsive element positioned to releasably retain the seal cap in the sealed state, the thermally-responsive element configured to operate in response to ambient temperature reaching a predetermined temperature, thereby releasing the seal cap from the sealed state;

(d) at least two support members, each having (i) an upper end connected to the outlet end of the body, and (ii) a lower end; and (e) a deflector connected to the lower end of each of the at least two support members, and configured to deflect the fluid that flows through the output orifice upon release of the seal cap from the sealed state; and (B) a support cup for supporting the fire protection sprinkler, the support cup comprising:

(a) a cylindrical threaded outer wall that surrounds a portion of the fire protection sprinkler; and (b) a mounting platform with a central hole into which the body of the sprinkler is inserted.

6. The fire protection sprinkler and support cup assembly according to claim 5, wherein the fire protection sprinkler has a K-factor in a range from 2.8 gpm/(psi)$^{1/2}$ to 5.8 gpm/(psi)$^{1/2}$, inclusive.

7. The fire protection sprinkler and support cup assembly according to claim 5, wherein the central hole of the mounting platform of the support cup has a threaded rim portion that interlocks with the threaded base of the body of the fire protection sprinkler.

8. The fire protection sprinkler and support cup assembly according to claim 5, wherein the central hole of the mounting platform of the support cup has tabs that interlock with the threaded base of the body of the fire protection sprinkler.

9. The fire protection sprinkler and support cup assembly according to claim 5, wherein the polymeric material is polytetrafluoroethylene.

10. The fire protection sprinkler and support cup assembly according to claim 5, wherein the polymeric material is fluorinated ethylene propylene.

* * * * *